US006305779B1

(12) United States Patent
Capurso et al.

(10) Patent No.: US 6,305,779 B1
(45) Date of Patent: Oct. 23, 2001

(54) MEMS INKJET NOZZLE CLEANING AND CLOSING MECHANISM

(75) Inventors: Robert G. Capurso, Bergen; Scott C. Robinson, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/290,030

(22) Filed: Apr. 9, 1999

(51) Int. Cl.[7] ..... B41J 2/165
(52) U.S. Cl. ..... 347/33
(58) Field of Search ..... 347/29, 33, 44, 347/36

(56) References Cited

U.S. PATENT DOCUMENTS 4,647,013 3/1987 Giachino et al. .
4,826,131 5/1989 Mikkor .
5,029,805 7/1991 Albarda et al. .
5,238,223 8/1993 Mettner et al. .
5,644,177 7/1997 Guckel et al. .
5,767,877 6/1998 Mei et al. .
5,810,325 9/1998 Carr .

*Primary Examiner*—John Barlow
*Assistant Examiner*—Michael S. Brooke
(74) *Attorney, Agent, or Firm*—Walter S. Stevens

(57) ABSTRACT

MEMS inkjet nozzle cleaning and closing mechanism. An inkjet nozzle closing mechanism (1) having a slider (2) attached to the face of a nozzle plate (5). The nozzle plate (5) has a front face (5*a*) and a reservoir side which abuts the ink flow. A gear (10) and rack (4) are incorporated to actuate the movement of the slider (2). The slider (2) has cutouts (6) which cause the orifices (11) to be in either an open or closed state depending upon the position of the slider (2). The horizontal motion of the slider (2) wipes away any ink residue which causes build-up which may eventually block the orifices (11).

10 Claims, 4 Drawing Sheets

MEMS INKJET NOZZLE CLEANING AND CLOSING MECHANISM

FIELD OF THE INVENTION

The invention relates to an inkjet nozzle closing and cleaning system. More specifically, to a Micro-electromechanical Systems inkjet nozzle cleaning mechanism which uses miniature gearing system to open and close the nozzle and preventing ink build-up associated with printers and the like.

BACKGROUND OF THE INVENTION

Micro-electromechanical Systems (MEMS) is a mechanical class of systems that are physically small. These systems have both a mechanical and electrical components. MEMS originally used to modify integrated circuit or computer chip fabrication techniques and materials to create very small mechanical devices. There are two main categories of MEMS, sensors and actuators. Polysilicon resonator transducers are an example of a MEMS sensor using a stress controlled thin film Polysilicon process which is a modification of the integrated circuit techniques. The high aspect ratio electrostatic resonator is an example of a linear actuator. The center mass, springs and electrostatic fingers are free while the rest of the structure is fixed to the substrate. Movement occurs by applying a voltage between the center structure and one of the side fixed structures. The overlapping fingers of this device allow voltage to occur over a large area resulting in a larger attractive force.

The use of this technology to make silicon inkjet nozzle array by chemical etching is taught in U.S. Pat. No. 4,157,935 issued to Solyst and by Tamai in U.S. Pat. No. 4,455,192.

U.S. Pat. No. 4,647,013 issued to Giachino et al. and U. S. Pat. No. 4,826,131 teach two complex silicon valve arrangements that have two planar silicon members. One having an orifice for passing fluid and the other that is movable for closing opening and closing the orifice.

U.S. Pat .No. 5,029,805 issued to Albarda et al. teaches a micro valve arrangement which opens and closes. An actuating drive connected to an electrical power source, whereby when an electrical current is applied the actuating drive flexes to open or close off the valve.

An even more complex valve design is taught in U.S. Pat. No. 5,644,177 issued to Guckell et al. In that design an actuator is attached to a plunger to effectuate the opening and closing of the valve. A magnetic core having a gap is fixed on the substrate and the plunger is mounted by a spring for movement parallel to the substrate in response to the flux provided to the gap of the fixed core.

U.S. Pat. No. 5,767,877 issued to Mei et al. teach a micro-valve array for a toner jet printer formed by MEMS technology having conducting plates which act as a closing means for each micro-valve.

U.S. Pat. No. 5,810,325 issued to Carr teaches a micro-valve arrangement which uses compressor pressure to close off a valve opening.

While the prior art teach micro-valves and various methods of for opening and closing off fluid flow. The prior art is silent on either a method or apparatus which clean and prevent the ink build-up associated with inkjet printers which have infrequent usage. The inventors have developed a cleaning mechanism and system which both clean and prevent ink blockage associated with inkjet printers of infrequent usage.

SUMMARY OF THE INVENTION

The present invention addresses the problems associated with inkjet printers subject to infrequent usage and ink build-up at its orifices, by developing a nozzle plate made of a silicon substrate which has a simple mechanism using MEMS technology to create a sliding nozzle cover. The advantage to the present invention is that a nozzle array has a plurality of openings from which ink is propelled, inherently become clogged when ink dries around the nozzle opening. This clogging causes failed or misfired nozzles resulting in poor image quality as well as printer down time to run through a standard cleaning process.

The present invention uses an arrangement that incorporates miniature mechanisms that wipe the excess and dried ink from the nozzle opening. This will not only maintain the nozzles and keep them from drying out, but eliminates the need for expensive and awkward cleaning and capping systems. A simple cap does not address the problem in that they often have a poor seal, thus causing air gaps which allows the ink to dry out. The present invention eliminates the need for caps and overcomes the need to clean the reservoir side of the opening, because ink is closed at the surface where the ink needs to be stopped.

It is then an object of the invention to provide a nozzle cleaning plate for an inkjet printer.

It is further object of the present invention to provide a nozzle closure device using MEMS technology.

It is a further object of the present invention to provide such an apparatus with an arrangement where a mechanism on the face of the nozzle plate wipes the nozzle openings as needed while in the print mode.

Another object of the invention is to provide an inexpensive and simple method to clean ink build-up around the nozzle of inkjet printers.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

There may be additional structures described in the foregoing application which are not depicted on one of the described drawings. In the event such a structure is described but not depicted in a drawing, the absence of such a drawing should not be considered as an omission of such design from the specification.

DETAILED DESCRIPTION OF THE INVENTION

Figure 1:
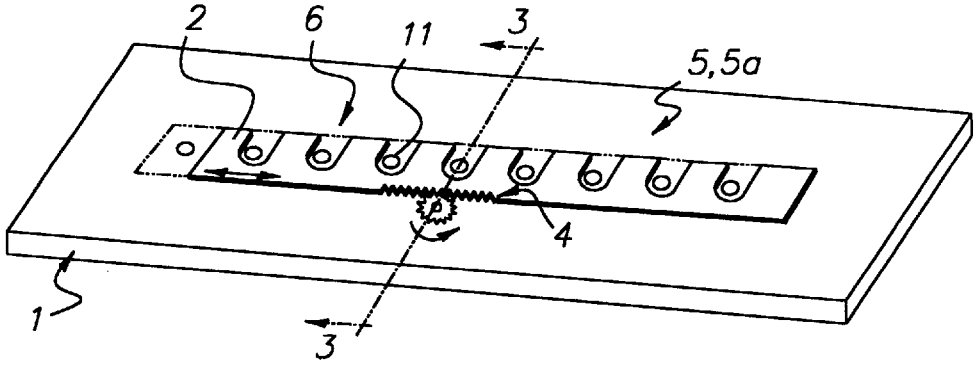
FIG. 1 shows a first embodiment of the invention.

The invention has been described in detail with particular reference to certain preferred embodiments thereof, but it will be understood that variations and modifications can be effected within the spirit and scope of the invention. FIG. 1 depicts an embodiment of the inkjet nozzle closing mechanism (1) having a slider (2) attached to the face of the nozzle plate (5). The nozzle plate (5) has a front face (5*a*) and a reservoir side which abuts the ink flow. A gear (10) and rack (4) are incorporated to actuate the movement of the slider (2). The slider (2) has cutouts (6) which cause the orifices (11) to be in an open and closed state. The horizontal motion of the slider (2) wipes away any ink residue which causes build-up and eventually blocks the orifices (11). The gear (10) and rack (4) are formed by using the MEMS technology. The cutouts (6) are either unshaped or circular openings that are sized so that when the slider (2) is in the open position the orifices (11) have an unrestricted flow.

Figure 2:
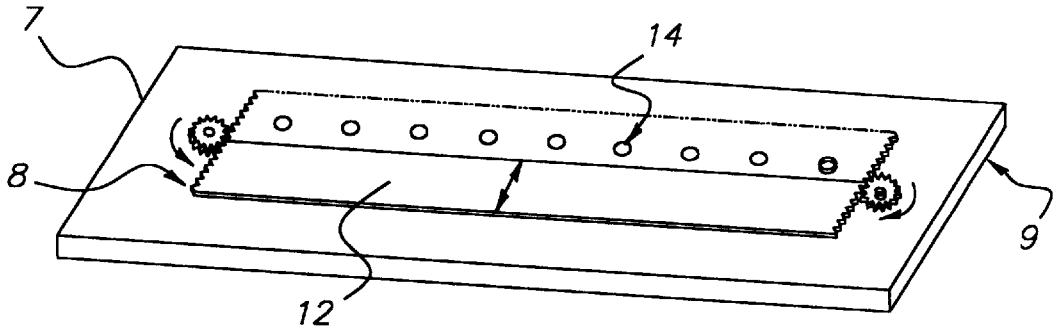
FIG. 2 shows a second embodiment of the invention.
Figure 3:
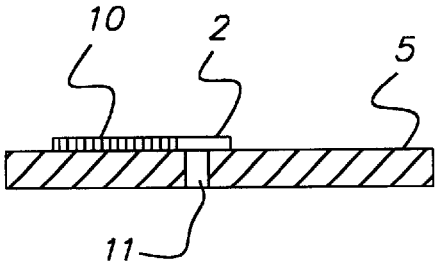
FIG. 3 shows a section of the invention taken at 3—3.

Referring to FIG. 2 the invention as embodied has a nozzle plate (7) a slider (12) with racks (8) on each end of the slider (12) attached to dual gears (9). This gear arrangement causes the slider (12) to move in a vertical direction across face of the nozzle plate wiping away any ink residue at the orifices (14).

Figure 4:
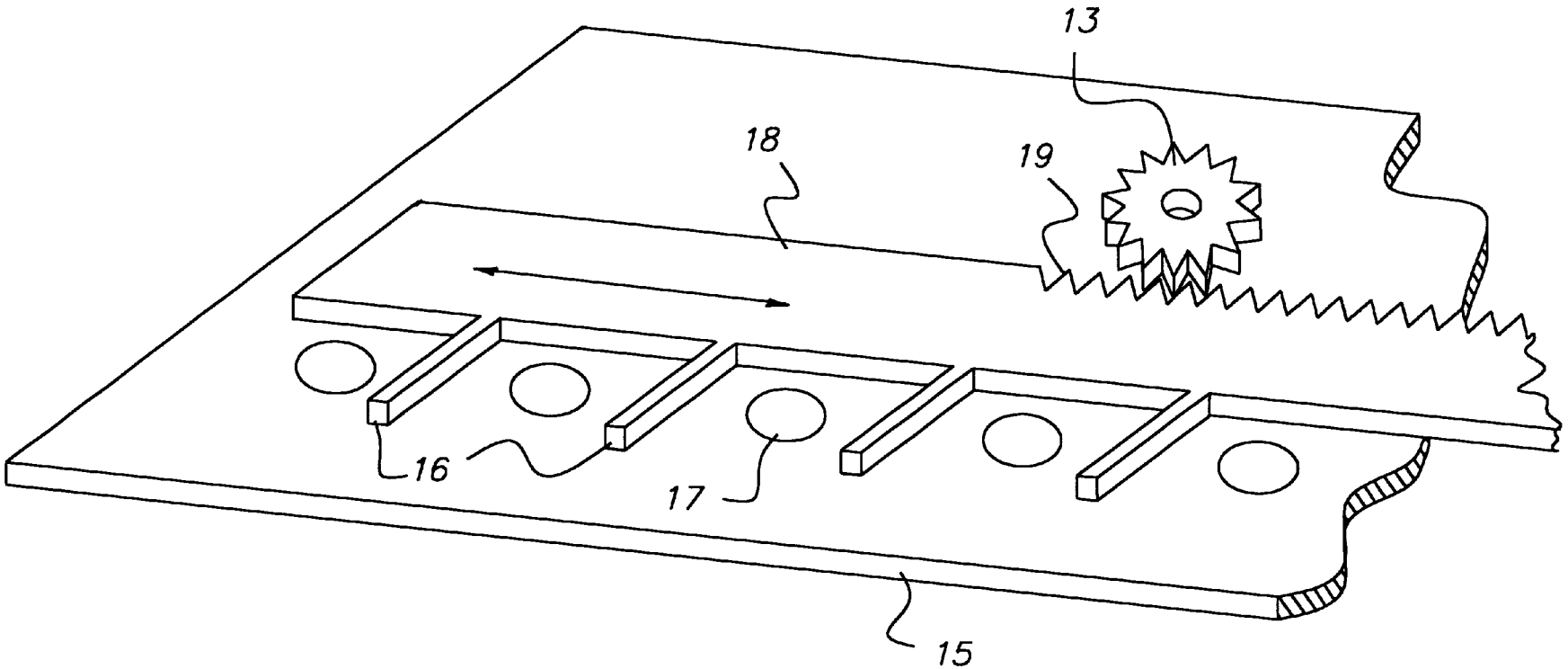
FIG. 4 shows a third embodiment of the invention.
Figure 5:
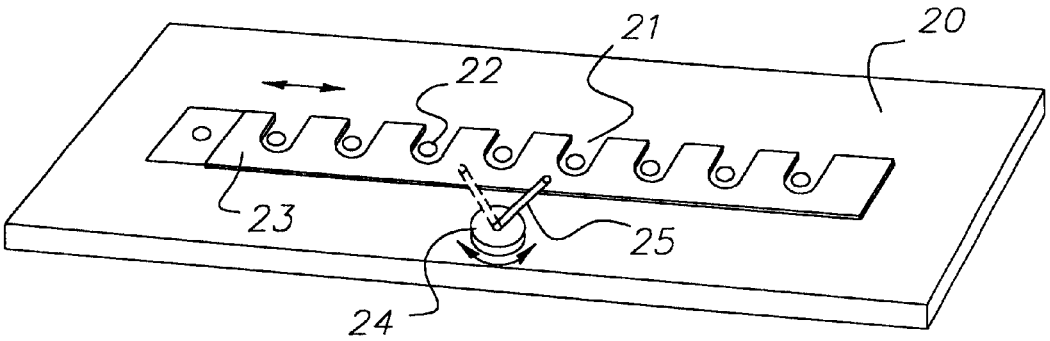
FIG. 5 shows a fourth embodiment of the invention.

FIG. 4 depicts an embodiment having a slider (18) which moves in a horizontal direction across the face of the nozzle plate (15). The slider (18) has finger-like appendages (16) which sweeps across the orifices (14) during its horizontal motion. The gear (13) and rack (19) are attached to the face of the nozzle plate (15). The interaction of the gear (13) with the rack (19) causes the slider (18) to move in its horizontal directions.

Figure 6:
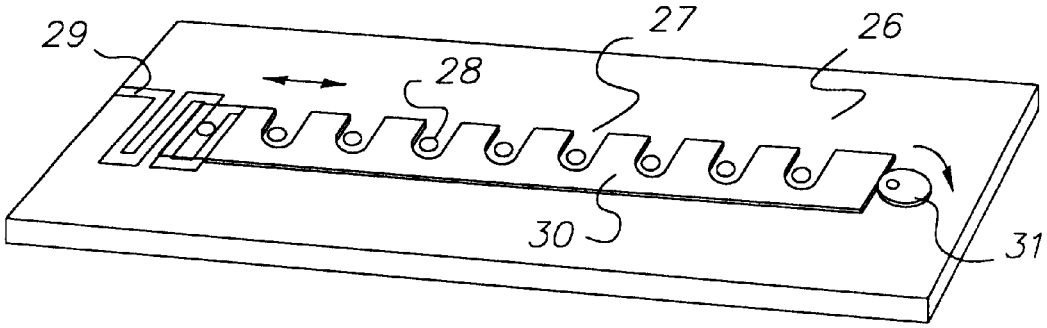
FIG. 6 shows a fifth embodiment of the invention.

In another embodiment the nozzle plate (20) has plurality of orifices (22) that are closed by a slider (23). The slider (23) has a series of cutouts (21) connected to an armature (25). The armature (25) is attached to a rotating member (24). The rotating member (24) rotates causing the armature (25) to move in a reciprocating manner which moves the slider (23) in a horizontal direction. In FIG. 6 an embodiment is depicted having a spring mechanism (29) attached to the nozzle plate (26). The slider (30) has cutouts (27) which slides across the orifices (28) as the cam (31) causes the slider (30) to push against the spring mechanism (29).

Figure 7:
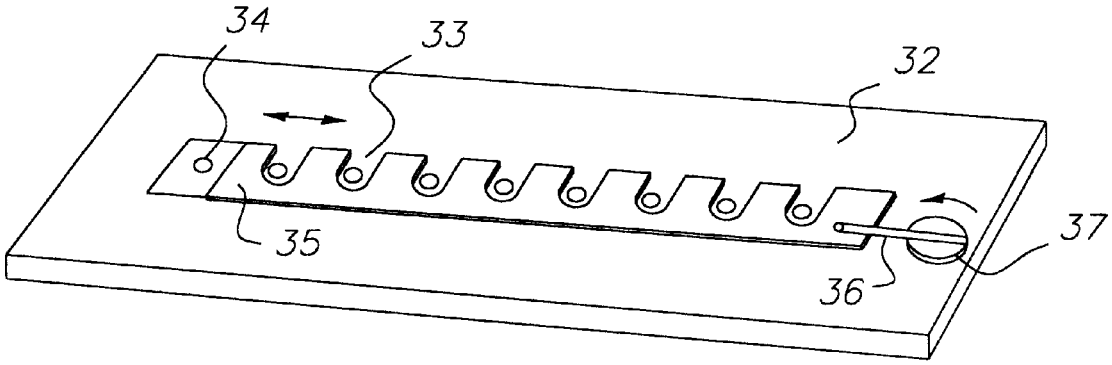
FIG. 7 shows a sixth embodiment of the invention.
Figure 8:
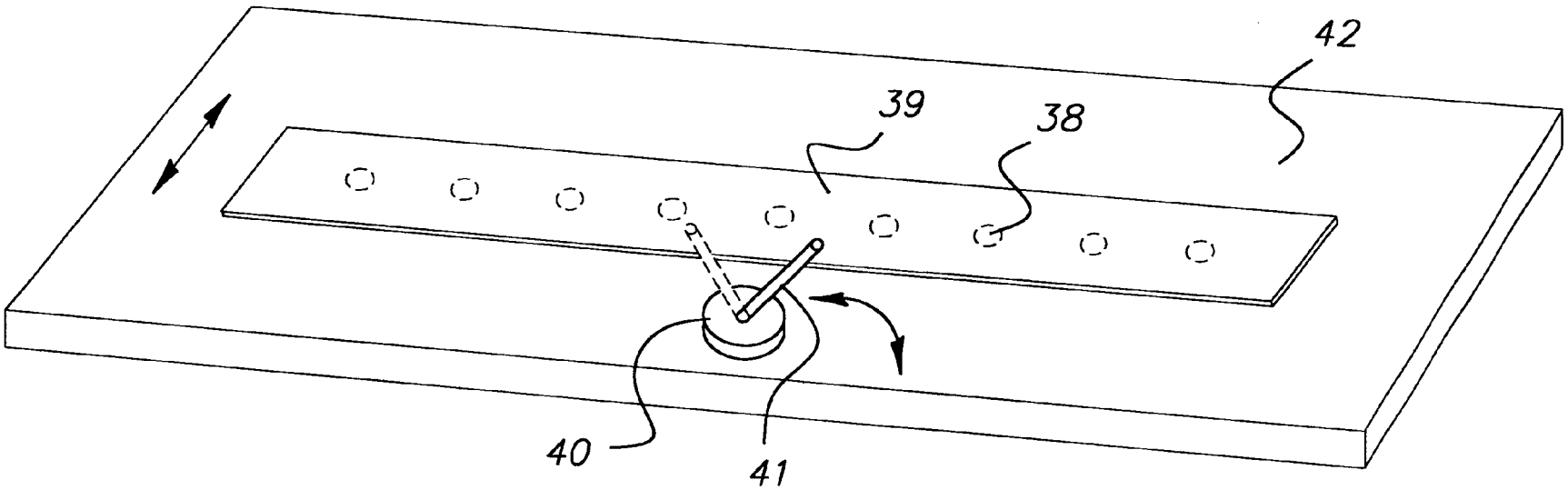
FIG. 8 shows a seventh embodiment of the invention.

FIG. 7 shows the nozzle plate (32) having a plurality of orifices (34) which are opened and closed by the slider (35). The slider (35) moves in a horizontal direction as the rotating member (37) rotates and the armature (36) moves in a reciprocating manner. FIG. 8 shows the nozzle plate (42) having a slider (39) attached by a rotating member (40) and an armature (41) which moves in a vertical direction. The orifices (38) are cleaned and closed by the slider (39) as the rotating member (40) rotates causing the armature (41) to move in a reciprocating manner.

Further modification and variation can be made to the disclosed embodiments without departing from the subject and spirit of the invention as defined in the following claims. Such modifications and variations, as included within the scope of these claims, are meant to be considered part of the invention as described.

The invention has been described in detail with particular reference to certain preferred embodiments thereof, but it will be understood that variations and modifications can be effected within the spirit and scope of the invention.

PARTS LIST

1—Nozzle Cleaning Mechanism
2—Slider
3—Cross-section of the Nozzle plate taken at 3
4—Rack
5—Nozzle Plate
5*a*—Nozzle face
6—Cutout
7—Nozzle Plate
8—Rack
9—Gear
10—Gear
11—Orifice
12—Slider
13—Gear
14—Orifice
15—Nozzle Plate
16—Slider Appendages
17—Orifice
18—Slider
19—Rack
20—Nozzle Plate
21—Cutout
22—Orifices
23—Slider
24—Cam
25—Armature
26—Nozzle Plate
27—Cutout
28—Orifices
29—Spring Mechanism
30—Slider
31—Cam
32—Nozzle Plate
33—Cutout
34—Orifices
35—Slider
36—Armature
37—Cam
38—Orifices
39—Slider
40—Cam
41—Armature
42—Nozzle Plate

What is claimed is:

1. A nozzle closing and cleaning apparatus for removing ink residue for an ink jet printer comprising:

a nozzle outlet surface having a plurality of orifices from which ink is ejected;

a slider in the form of a plate overlying the outlet surface and movable along the surface to wipe excess and/or dried ink from the surface, the slider including a plurality of openings wherein respective openings coincide with respective ones of said orifices in a stationary position of the slider; and a MEMS transport member for imparting motion to said slider, said transport member including a gear rack and pinion gear arrangement cooperating to drive said slider along the surface to wipe excess and dried ink from the surface and to move the slider to a second stationary position wherein the slider covers the orifices when the printer is not in use for printing.

2. The apparatus of claim 1 wherein said orifices are arranged in a row and when said transport member imparts motion to said slider the motion of the slider is in a direction along said row and the orifices are closed and opened as said slider passes over said orifices.

3. The apparatus of claim 2 and wherein the gear rack is formed on the slider.

4. A nozzle closing apparatus for inhibiting drying of ink in an ink jet printer comprising:

a nozzle outlet surface having a plurality of orifices from which ink is ejected;

a slider in the form of a plate overlying the outlet surface and movable along the surface to wipe excess and/or dried ink from the surface, the slider including a gear rack formed on the slider; and a MEMS transport member for imparting motion to said slider, said transport member including a pinion gear arrangement cooperating to engage said rack and drive said slider along the surface to move the slider to a stationary position wherein the slider covers the orifices when the printer is not in use for printing.

5. The apparatus of claim 4 and wherein the slider includes plural separate gear racks and the transport member comprises plural pinion gears each engaging a respective one of the gear racks to drive the slider to the stationary position where the slider covers the orifices when the printer is not in use for printing.

6. The apparatus of claim 4 and wherein the slider includes a plurality of openings so that respective ones of said openings overlie respective ones of said orifices when the ink jet printer is in an operating mode for printing.

7. A nozzle closing and cleaning method for removing ink residue for an ink jet printer comprising:

providing a nozzle outlet surface having a plurality of orifices from which ink is ejected during printing;

during a nonprinting mode of the printer, moving a slider in the form of a plate which overlies the outlet surface along the surface to wipe excess and/or dried ink from the surface, the slider including a plurality of openings wherein respective openings coincide with respective ones of said orifices in a first stationary position of the slider when ink is ejected from the orifices during printing; and actuating a MEMS transport member to impart motion to said slider, said transport member including a gear rack and pinion gear arrangement cooperating to drive said slider along the surface to wipe excess and/or dried ink from the surface and to move the slider to a second stationary position wherein the slider covers the orifices when the printer is not in use for printing to reduce drying of the ink in the orifices.

8. The method of claim 7 and wherein the gear rack is formed on the slider.

9. A method for inhibiting drying of ink in an ink jet printer comprising:

providing a nozzle outlet surface having a plurality of orifices from which ink is ejected during a printing mode of the printer;

providing a slider in the form of a plate overlying the outlet surface, the slider moving along the surface from a first stationary position wherein the slider does not block ejection of ink from the orifices to a second stationary position wherein the slider covers the orifices to reduce drying of ink in the orifices, the slider including a gear rack formed on the slider;

operating a MEMS pinion gear which engages the rack to drive the slider between the first position and the second position.

10. The method of claim 9 and wherein the slider includes a plurality of openings which overlie the orifices when the slider is in the first stationary position.

* * * * *